United States Patent [19]

Beck

[11] 4,102,635

[45] Jul. 25, 1978

[54] METHOD OF AND AN ARRANGEMENT FOR PRE-HEATING COKING COAL

[75] Inventor: Kurt-Günther Beck, Essen, Fed. Rep. of Germany

[73] Assignee: Bergwerksverband GmbH, Essen, Fed. Rep. of Germany

[21] Appl. No.: 806,277

[22] Filed: Jun. 13, 1977

[30] Foreign Application Priority Data

Jun. 15, 1976 [DE] Fed. Rep. of Germany ..... 2626653

[51] Int. Cl.[2] ..... F26B 3/08

[52] U.S. Cl. ..... 432/14; 432/18; 34/10; 34/57 A

[58] Field of Search ..... 432/15, 14, 16, 18, 432/58, 190, 191; 34/10, 57 A, 57 B; 202/31, 121

[56] References Cited

U.S. PATENT DOCUMENTS

| | | | |
|---|---|---|---|
| 2,538,833 | 1/1951 | DeRyoke | 34/57 A |
| 2,763,478 | 9/1956 | Parry | 34/57 A |
| 4,057,908 | 11/1977 | Mirliss et al. | 432/58 |

*Primary Examiner*—Louis J. Casaregola
*Attorney, Agent, or Firm*—Michael J. Striker

[57] ABSTRACT

Coal to be supplied to a coking oven is pre-heated, in a single pre-heating zone, such as in a conveying riser, first by heat yielded to it by a gaseous carrier medium entraining the coal for joint passage through the riser, and then additionally pre-heated by heat yielded to it by a gaseous fluid, such as hot combustion products, introduced into the pre-heating zone at a region thereof at which the temperature of the coal has already risen to a predetermined value, such as 80° to 100° C. The additional pre-heating of the coal results in a final temperature of the latter at the exit of the riser of more than 130° C, preferably between 150° and 250° C. The stream of the carrier medium with the coal entrained therein flows upwardly through the riser which is substantially vertical, the coal being entrained at the lower end and separated from the mixture of the carrier medium with the gaseous fluid at the upper end of the riser. A part of the above-mentioned mixture may be circulated to the lower end of the riser for use as the carrier medium. The flow-through cross-sectional area of the pre-heating zone may be larger downstream than upstream of the region at which the gaseous fluid is introduced for maintaining the speed of flow through the pre-heating zone constant despite the addition of the gaseous fluid.

15 Claims, 1 Drawing Figure

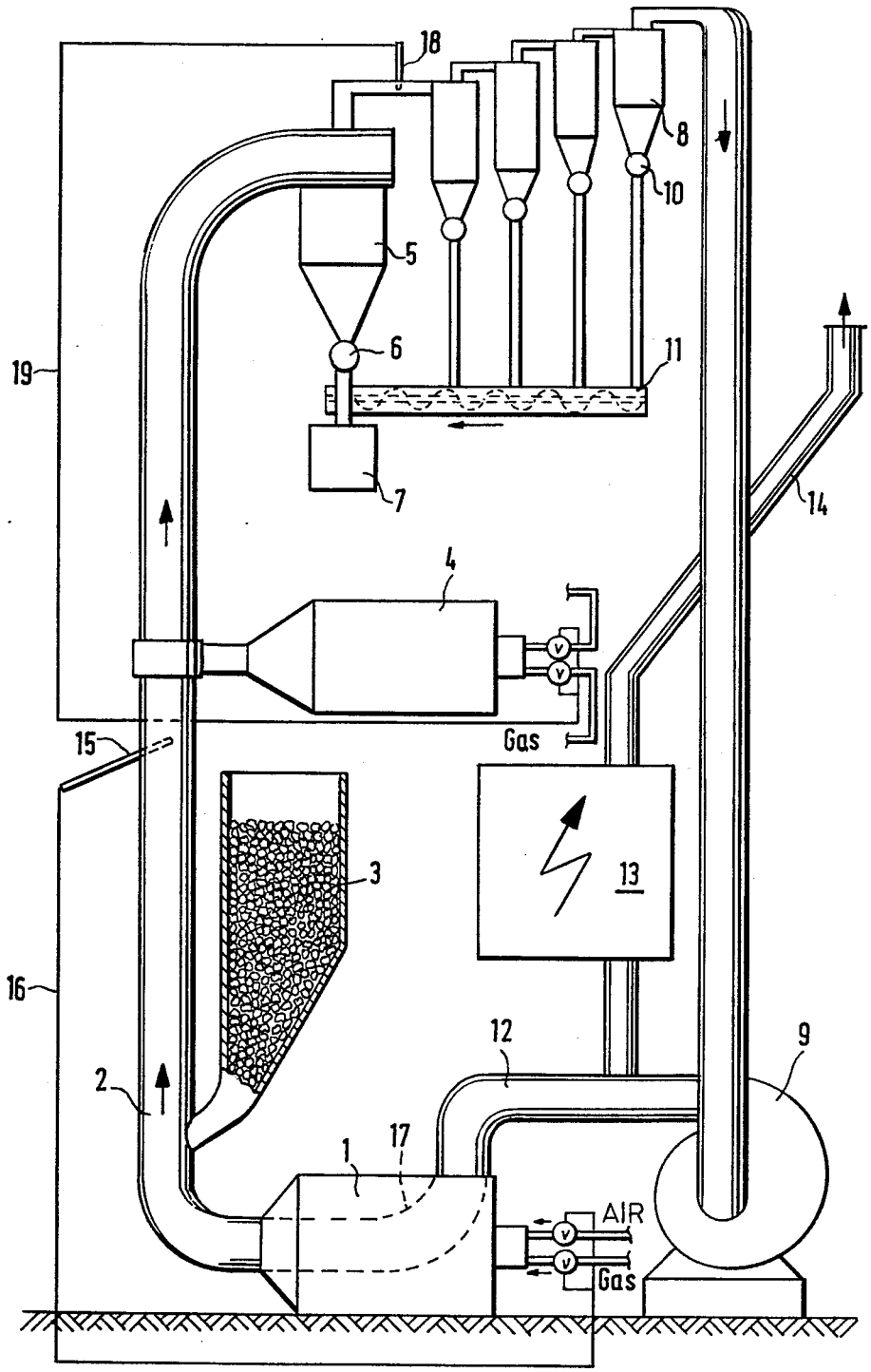
18
8
10
5
6
11
19
7
14
4
Gas
15
3
13
16
12
9
2
17
1
AIR
Gas

METHOD OF AND AN ARRANGEMENT FOR PRE-HEATING COKING COAL

BACKGROUND OF THE INVENTION

The present invention relates to a method of and an arrangement for pre-heating coal in general, and more particularly to such a method and arrangement as used for pre-heating coal to be supplied to a coking oven.

Various pre-heating arrangements and methods have already been proposed. In the coking industry, the pre-heating of the coal to be supplied to the coking oven by passing the coal, entrained in a stream of gaseous carrier medium at a high temperature, through a one or two stage conveying riser in which the carrier medium yields heat to the coal and thus pre-heats the same, has found widespread acceptance. When it is desired to dry the coal, for instance, by heating the same to about 90° C, it is usually sufficient to use a one-stage arrangement; on the other hand, when it is desired to heat the coal to a temperature as high as 250° C, it is recommended to use a two-stage type system in which the coal is dried in the first stage until the moisture content thereof is reduced to 1 to 2%, while the coal achieves a temperature of 85° to 90° C. Then, the moisture liberated from the coal in the first stage is withdrawn from the pipe system, and the coal is additionally heated in a second stage or pipe which is arranged downstream of the first stage or pipe.

Attempts have already been made to accomplish the entire pre-heating operation for the coking coal, to a final temperature of the coal of about 250° C, in a single conveying riser. However, under these circumstances, in order to be able to elevate the temperature of the coking coal to the desired level, it was necessary to adjust the input temperature of the carrier medium to such a high level that, as a result of the spontaneous water evaporation in the moist coking coal, a large part of the coal granules or bodies disintegrated or burst. In addition thereto, oxidation of the coal took place, which resulted in a highly undesirable impairment of the capability of the coal to sinter during the coking operation.

However, it has been now established that it would be very advantageous if the pre-heating of the coking coal to temperatures above 130° C, preferably 150° to 250° C, could be accomplished in a single conveying riser, if it could be assured that the above-discussed disadvantages of the prior-art approaches can be avoided.

SUMMARY OF THE INVENTION

Accordingly, it is a general object of the present invention to avoid the disadvantages of the prior art.

More particularly, it is an object of the present invention to develop a method of pre-heating coking coal which does not have the above-discussed disadvantages of the prior art methods.

Yet more particularly, it is an object of the present invention to devise a method of pre-heating coking coal which is simple and reliable and which can be performed in a single pre-heating zone.

A concomitant object of the present invention is to design an arrangement for performing the above method, which is simple in construction, reliable in operation and inexpensive to manufacture.

Still another object of the invention is to so construct the above-mentioned arrangement as to render an economical operation thereof possible.

In pursuance of these objects and others which will become apparent hereafter, one feature of the present invention resides, briefly stated, in a method of pre-heating coking coal which comprises the steps of entraining the coal in a stream of a gaseous carrier medium which is at a first temperature exceeding that of the coal; passing the stream through a pre-heating zone in which the carrier medium pre-heats the coal; and introducing into said pre-heating zone, at a region thereof at which the coal has already been pre-heated to a predetermined temperature by by carrier medium, a gaseous fluid at a second temperature exceeding that of the carrier medium at said region for additionally pre-heating the already partly pre-heated coal in said zone at and downstream of said region.

A particularly advantageous method is obtained when a part of the gaseous mixture of the carrier medium with the fluid is used as the carrier medium in the entraining step, subsequent to the separation of the pre-heated coal from such gaseous mixture. Instead of, or in addition to, the circulated gaseous mixture, hot combustion gases may be used as the carrier medium. The introducing step may include admitting hot combustion products into the pre-heating zone.

As a result of the above-outlined method, the bursting and oxidation of the coal are avoided. This is due to the fact that the heating of the coal is gradual, the temperature differential between the carrier medium and the coal being rather low during the initial drying and pre-heating operation, while the coal is substantially dry when it comes into contact with the gaseous fluid, preferably the combustion products, the latter having only a low, if any, oxidizing capability.

Furthermore, when the gaseous mixture exiting from the pre-heating zone is used as the carrier medium for entraining the coal, the sensible heat of such mixture can be again utilized for the initial pre-heating of the coal, so that this heat is not wasted.

A considerable advantage of the method of the invention resides in the fact that the above-mentioned mixture, including vapors, exits from the pre-heating zone at a temperature of between 300° and 400° C, so that there is no need to be afraid that sulfuric acid could precipitate from such mixture and attack the various components of the arrangement performing the method. This is a considerable improvement as compared with the two-stage method and arrangement of the prior art wherein the carrier medium which exits from the first stage and is conducted out of the system is at a temperature of a mere 100° to 150° C, so that the danger of deposition of the sulfuric acid and corrosion of the following apparatus, such as scrubbers or the like, by the sulfuric acid, is a very real possibility. Furthermore, it is necessary to purify the gaseous medium exiting from the first stage of the two-stage arrangement in a special and expensive purifying operation, before the remainder of the gaseous medium can be discharged into the ambient atmosphere. A very important advantage of the method of the present invention resides in the fact that, as compared with the two-stage method, it is no longer necessary to provide double additional equipment, that is, one set for each stage, such additional equipment including, for instance, scrubbers, cyclones, locks and the like. The method of the invention also avoids the energy losses which have heretofore had to be accepted and which resulted from the conveyance of the partially pre-heated or at least dried coal to the lower end of the conveying riser of the second stage.

The introduction of the gaseous fluid, such as combustion products, into the stream of carrier medium with the coal entrained therein, results in an increase in the volume of the carrier gas. In order to maintain the flow conditions in the conveying riser constant over the entire length of the riser, it is further proposed according to the present invention to increase the flow-through cross-sectional area of the conveying riser in the upper portion thereof, that is, downstream of the region of introduction of the gaseous fluid into the pre-heating zone.

As already mentioned above, the circulated gaseous mixture may be introduced into the conveying riser together with a heat-carrier medium, such as combustion products obtained by combusting a combustible mixture in a combustion chamber. As a result of this procedure, it is assured that the drying of the coal up to the above-mentioned region is always achieved to the desired level, while the temperature of the circulated mixture may temporarily fall below the dew point.

The pre-heated coal obtained at the upper end of the conveying riser is separated from the gaseous mixture in a conventional manner, such as in a series of cyclones, and then a part of the mixture is circulated and thus returned into the lower part of the riser. The remainder of the gaseous mixture is expelled into the ambient atmosphere, after passing through dust-removing apparatus such as an electrostatic precipitator and/or a venturi scrubber.

The method of the present invention allows for selective pre-heating of moist coal to a temperature of 120° to 250° C, preferably between 150° to 180° C. In dependence on the temperature of the gaseous fluid, which is introduced into the riser pipe at the central portion thereof and which is at a temperature of, for instance, 1200° to 1700° C, preferably 1400° to 1600° C, the temperature of the gaseous mixture exiting from the pre-heating zone is approximately 300° to 500° C or even higher. The temperature of the gaseous fluid must, therefore, be also selected in accordance with the operating parameters of the arrangement, that is, whether the method is performed with or without circulation of the gaseous mixture and with or without admission of combustion products, alone or together with the circulated gaseous mixture, to the lower end of the conveying riser.

The method of the present invention has a further advantage that, because of the considerable height of the single conveying riser, amounting to approximately 40 to 70 meters, all of the additional equipment which is needed in connection with the method of the present invention, such as cyclones, storage hoppers, mixing screw conveyors, metering hoppers and conveyors for the forwarding of the pre-heating coal, can be arranged in a row above one another. All other additional equipment for performing the method, such as combustion or burning chambers, blowers, cyclones or the like, can be situated at the floor level so that a compact and simple arrangement is obtained as a whole for the performance of the method. An additional aspect of the present invention resides in an arrangement for performing the above-discussed method, which arrangement comprises means for entraining the coal in a stream of a gaseous carrier medium which is a first temperature exceeding that of the coal; means for confining the stream for passage through a pre-heating zone in which the carrier medium pre-heats the coal; and means located at a region of said confining means at which the coal has already been pre-heated to a predetermined temperature by the carrier medium and communicating with said zone at said region for introducing into the latter a gaseous fluid at a second temperature exceeding that of the carrier medium at said region and thus additionally pre-heating the already partly pre-heated coal in said zone at and downstream of said region. The arrangement further includes means for circulating part of the gaseous mixture from the downstream end to the upstream end of the pre-heating zone, for use of the mixture as the carrier medium. Furthermore, the arrangement includes combustion or burning chambers in which combustible mixture is combusted and the combustion products are then introduced into the heating zone, either as at least a part of the carrier medium, or as the gaseous fluid.

Preferably, the confining means includes a conveying riser which has a substantially vertical orientation, the entraining means being located at the lower end of the riser and the stream flowing through the riser in the upward direction, the introducing means being situated at a central portion of the conveying riser. Advantageously, in order to maintain the flow conditions through the entire riser constant, the flow-through cross-sectional area of the conveying riser is larger upwardly than downwardly of the central portion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The sole FIGURE of the drawing is a somewhat diagrammatic side elevational view of an arrangement for performing the method of the present invention for pre-heating coking coal.

DETAILED DISCUSSION OF THE PREFERRED EMBODIMENT

Referring now to the drawing in detail it may be seen that the reference numeral 1 designates a combustion chamber in which hot combustion products are generated. By admixing a gaseous mixture to the combustion products, the temperature of the latter is reduced to about 400° C. The so-obtained mixture, or carrier medium, enters a vertically oriented conveying riser 2 at a lower end thereof. Wet coal is introduced from a storage hopper 3 into the conveying riser 2 at a lower portion of the latter. The carrier medium entrains the wet coal and transports the same upwardly, while simultaneously heat yielded by the carrier medium to the coal causes evaporation of the moisture from the coal and thus results in drying of the same. During this drying procedure, the carrier medium is cooled to about 150° to 200° C.

In order to be able to further pre-heat the coal, during the further upward transportation thereof through the conveying riser 2, to 200° C, for instance, the temperature of the carrier medium is increased to approximately 550° C by introducing hot combustion products having a temperature of approximately 1500° C, from a burning chamber 4 arranged at the central region of the conveying riser 2, into the interior of the latter. Thereafter, the coal is pre-heated to the desired temperature of, for instance, 200° C during the movement thereof through the conveying riser 2 downstream, that is upwardly, of the region of introduction of the combustion product or gaseous fluid issuing from the chamber 4, on its way toward a main cyclone 5. When it is desired to only provide a single burning chamber without, however, dispensing with the additional pre-heating of the carrier medium, it is merely necessary to make the burning chamber 4 somewhat larger and to provide a conduit, not illustrated in the drawing, which communicates the burning chamber 4 with the lower portion of the conveying riser 2.

Most of the coal is separated from the gaseous mixture in which it was previously entrained in the main cyclone or a similar separator 5, and then the coal is conducted through a lock 6, such as a compartment-wheel lock, to a conveyor 7, such as a drag-link conveyor, which takes care of the further transportation of the pre-heated coal.

The gaseous mixture, including vapors, which exits from the main cyclone 5, is further purified in a series of cyclones 8, prior to the proceeding of the gaseous mixture, which is then at a temperature of between about 300° and 400° C, to a blower 9 which maintains the speed of propagation of the carrier medium through the conveyor riser 2 which is necessary for upwardly transporting the coal.

The coal dust which is separated from the gaseous mixture in the cyclones 8 passes through locks 10 on its way to a screw conveyor 11 which advances such dust toward the conveyor 7.

On the high-pressure side of the blower 9, a part of the gaseous mixture expelled therefrom is admitted, via a conduit 12, into the combustion chamber 1, while the remainder of the gaseous mixture leaves the arrangement through a stack 14 after passing through and purification in an electrostatic precipitator 13 and/or other purifying equipment, such as a scrubber or the like.

When desired, it is also possible to circulate the gaseous medium to the lower end of the conveying riser 2 in non-purified state, that is, from a point downstream of the main cyclone 5, and then only the remainder of the gaseous mixture which is to be discharged through the stack 14 into the ambient atmosphere is subjected to purification in the cyclones 8 and the electrostatic precipitator 13.

The regulation of the heat content of the heat-carrying medium flowing through the conveying riser 2, in the region between the combustion chamber 1 and the burning chamber 4, is accomplished by resorting to the use of a sensor 15 which is arranged at the downstream end of this region. The sensor 15 is connected, in a manner well known in the regulating field, with an arrangement for regulating the combustion process taking place in the combustion chamber 1, which controls the admission of air and of a combustible substance into the combustion chamber 1. However, the combustion chamber can be omitted, in which event the conduit 12 directly communicates with the lower portion of the conveying riser 2, as illustrated in broken lines. In addition thereto, also the temperature of the gaseous mixture in the region between the inlet from the burning chamber 4 and the main cyclone 5 is controlled, in conventional manner, by resorting to the use of a temperature sensor 18 and a conductor 19 which, again in a conventional manner, conducts signals from the sensor 18 to a control arrangement which controls the admission of air and a combustible substance into the interior of the burning chamber 4.

It will be understood that each of the elements described above, or two or more together, may also find a useful application in other types of constructions differing from the types described above.

While the invention has been illustrated and described as embodied in a method of and an arrangement for pre-heating coking coal, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of pre-heating coking coal, comprising the steps of entraining the coal in a stream of a gaseous carrier medium such is at a first temperature exceeding that of the coal; passing the stream through a pre-heating zone in which the carrier medium pre-heats the coal; and introducing into said pre-heating zone, at a region thereof at which the coal has already been pre-heated to a predetermined temperature by the carrier medium, a gaseous fluid at a second temperature exceeding that of the carrier medium at said region for additionally pre-heating the already partly pre-heated coal in said zone at and downstream of said region.

2. A method as defined in claim 1; and further comprising the steps of separating the pre-heated coal from a gaseous mixture of the carrier medium with the fluid subsequently to said passing step; and circulating a part of the gaseous mixture for use as the carrier medium in said entraining step.

3. A method as defined in claim 2, and further comprising the steps of combusting a combustible mixture; and adding the combustion products of said combusting step to the circulated gaseous mixture.

4. A method as defined in claim 1; and further comprising the steps of combusting a combustible mixture; and utilizing the combustion products of said combusting step as the carrier medium.

5. A method as defined in claim 1; and further comprising the steps of burning a combustible mixture; and wherein said introducing step includes admitting the combustion products of said burning step into said zone.

6. A method as defined in claim 1, wherein said passing step includes conveying the stream in an upward direction through said zone.

7. A method as defined in claim 1, wherein said passing step includes confining the stream for passage in a path the flow-through cross-sectional area of which is larger downstream than upstream of said region.

8. An arrangement for pre-heating coking coal, comprising means for entraining the coal in a stream of a gaseous carrier medium which is at a first temperature exceeding that of the coal; means for confining the stream for passage through a pre-heating zone in which the carrier medium pre-heats the coal; and means located at a region of said confining means at which the coal has already been pre-heated to a predetermined temperature by the carrier medium and communicating with said zone at said region for introducing into the latter a gaseous fluid at a second temperature exceeding that of the carrier medium at said region and thus additionally pre-heating the already partly pre-heated coal in said zone at and downstream of said region.

9. An arrangement as defined in claim 8, and further comprising means located downstream of said confining means and operative for separating the pre-heated coal from a gaseous mixture of the carrier medium with the fluid; and means for circulating a part of the gaseous mixture to said entraining means for use as the carrier medium thereat.

10. An arrangement as defined in claim 9; and further comprising means for combusting a combustible mixture; and means for adding the combustion products from said combusting means to the circulated gaseous mixture upstream of said entraining means.

11. An arrangement as defined in claim 8; and further comprising means for combusting a combustible mixture; and means for supplying the combustion products from said combusting means to said entraining means as the carrier medium.

12. An arrangement as defined in claim 8; further comprising means for burning a combustible mixture; and wherein said introducing means includes means for admitting the combustion products from said burning means into said zone.

13. An arrangement as defined in claim 8, wherein said confining means includes a conveying riser having a substantially vertical orientation, said entraining means being located at the lower end thereof and the stream rising therethrough; and wherein said introducing means is situated at a central portion of said conveying riser.

14. An arrangement as defined in claim 13; and further comprising means for separating the pre-heated coal from a gaseous mixture of the carrier medium with the fluid located at the upper end of said conveying riser.

15. An arrangement as defined in claim 13, wherein the flow-through cross-sectional area of said conveying riser is larger upwardly than downwardly of said central portion.

* * * * *

UNITED STATES PATENT AND TRADEMARK OFFICE

CERTIFICATE OF CORRECTION

PATENT NO. : 4,102,635

DATED : July 25, 1978

INVENTOR(S) : Kurt-Günther Beck

It is certified that error appears in the above-identified patent and that said Letters Patent are hereby corrected as shown below:

On the title page, the name and address of the second assignee should be added, and read -- Didier Engineering GmbH, Essen, Germany --.

Signed and Sealed this

*Twenty-first* Day of *June 1983*

[SEAL]

*Attest:*

DONALD J. QUIGG

*Attesting Officer*

*Acting Commissioner of Patents and Trademarks*